United States Patent [19]

Morgan, II et al.

[11] 4,337,034

[45] Jun. 29, 1982

[54] PROTECTIVE REFRACTORY MEMBER LOCKING DEVICE

[75] Inventors: John W. Morgan, II, Pittsburgh; Hans E. Leumann, Washington, both of Pa.

[73] Assignee: Bloom Engineering Company, Inc., Pittsburgh, Pa.

[21] Appl. No.: 231,228

[22] Filed: Feb. 2, 1981

[51] Int. Cl.[3] ..... F27D 3/02

[52] U.S. Cl. ..... 432/234; 138/147; 138/168; 292/108; 292/304

[58] Field of Search ..... 432/234; 52/486, 583; 138/147, 167, 168; 292/108, 304

[56] References Cited

U.S. PATENT DOCUMENTS

| | | | |
|---|---|---|---|
| 1,868,693 | 7/1932 | Capra | 292/108 |
| 2,703,431 | 3/1955 | Tatom | 292/108 |
| 3,025,093 | 3/1962 | Millman | 292/304 |
| 3,030,250 | 4/1962 | Losse | 138/147 |
| 3,061,349 | 10/1962 | Dellith | 292/304 |
| 4,182,609 | 1/1980 | Hovis et al. | 432/234 |
| 4,225,307 | 9/1980 | Magera | 432/234 |

*Primary Examiner*—John J. Camby

*Attorney, Agent, or Firm*—Webb, Burden, Robinson & Webb

[57] ABSTRACT

A protective refractory elongated hollow member for protecting pipe and the like in high temperature metallurgical furnaces comprises an arcuately shaped male part and an arcuately shaped female part interconnected at their respective longitudinal edges. The male part includes a clip partially embedded therewithin, which clip includes at least one hook and preferably two extending outward from the longitudinal edge of the part. The female part includes hook-receiving members such as loops partially embedded and extending from its longitudinal edge to receive the hooks. The hooks include locking means or preventive disengaging means for retaining the parts in assembled relationship.

9 Claims, 11 Drawing Figures

PROTECTIVE REFRACTORY MEMBER LOCKING DEVICE

FIELD OF THE INVENTION

This invention relates to furnace insulation systems and, more particularly, to protective refractory hollow members for protecting heat absorptive elongated elements through nonwelded attachments in metallurgical furnaces.

DESCRIPTION OF THE PRIOR ART

An increasing number of furnace insulation systems are being utilized in metallurgical furnaces to protect the metal structures contained therein such as the skid pipe, crossover pipe and other support members on pusher type furnaces as well as moving and fixed horizontal beams on walking beam furnaces. This pipe is normally hollow and water-cooled, thereby making them extremely heat absorptive. The pipe is protected to minimize the heat losses of the furnace and thus conserve energy. These insulation systems are subjected to high and cyclic temperatures, repetitive vibrations, scale build-up and occasional damaging blows from workpieces or chunks of metal and scale.

A number of early systems, many of which are still in use, provide semi-cylindrical sections of metal reinforced refractory insulation joined together and welded to the pipe. Typical of such an insulation system is that disclosed in U.S. Pat. No. 2,693,352.

The welding of a metal reinforced precast insulation material to support pipes or, alternatively, welding large numbers of anchors to pipes to accommodate insulation systems as well as the problems of cleaning off old weld or old anchors in preparation for reinstallation of insulation led to the development of weldless attachments. Such a weldless attachment is disclosed in U.S. Pat. No. 4,182,609 where the male part includes hooks extending from its longitudinal edges and the female part includes loops likewise extending from the longitudinal edges so that the parts can be joined in assembled relationship. Another weldless systems is disclosed in U.S. Pat. No. 3,781,167. In that patent the two parts to be joined include stainless steel strips having tabs with slots extending from the marginal edges. These slots are provided with enlarged mouths for initial engagement and alignment and the two parts are joined together by fitting these slots of the respective parts.

These protective members are normally constructed in short sections, e.g. three inches, six inches, or one foot, and a number of such members are then positioned in end to end relationship to protect the pipe within the furnace. Many applications result in small gaps at the end of a pipe or in the area of a bend in the pipe. Where such a space exists in the system, repetitive vibrational forces can cause the member comprised of two assembled parts to work free from one another, particularly where there are no welds involved.

SUMMARY OF THE INVENTION

Our refractory member provides a positive lock between the two parts in the assembled relationship so that vibrational forces or other conditions in the furnace cannot separate the parts defining the protective member.

Our invention is an improvement on protective refractory insulation systems for protective heat absorptive, elongated elements in a high temperature metallurgical furnace in which two parts are joined to form a protective member. The parts being joined include projection means such as hooks and projection receiving means such as loops extending from the respective longitudinal edges of the part to permit assembly of the member. The improvement comprises providing locking means associated with the projection means and the projection receiving means to lock the parts together once assembled.

DESCRIPTION OF THE PREFERRED EMBODIMENTS

Figure 1:
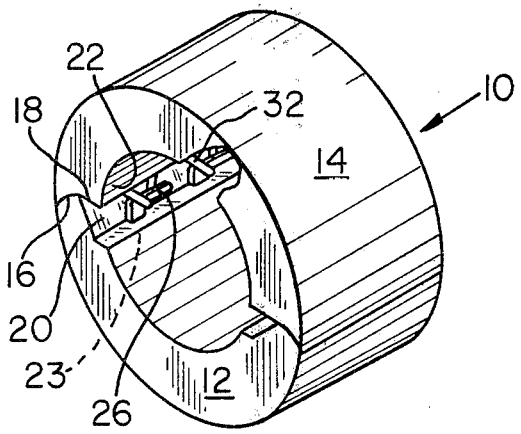
Fig. 1 PRIOR ART
FIG. 1 is a perspective view of a prior art protective refractory elongated hollow member.

The prior art refractory member disclosed in U.S. Pat. No. 4,182,609 is illustrated in FIG. 1. The refractory member, generally designated 10, is made up of two semi-cylindrical parts 12 and 14. While the parts are illustrated as semi-cylindrical, it will be recognized that the subject invention as well as the prior art member in FIG. 1 could be equally embodied in other shapes to protect and insulate the surface of elongated absorptive members or parts thereof such as pipe in high temperature metallurgical furnaces. The particular refractory member 10 includes a male part 12 having opposing longitudinal marginal edges 16 defining in part longitudinally extending recesses 20 positioned adjacent the interior surface of male part 12. Embedded within refractory part 12 is appropriate reinforcement such as reticulated metal mesh (not shown). Also embedded within the male part 12 are metal clips 23 having hooks 26 extending from each of the longitudinal edges 16 in the area of the recesses 20.

Female part 14 likewise includes appropriate reinforcement and has hook-receiving loops 32 extending from the longitudinal edges 18 in the area of the respective recesses 22. The member 10 is formed through the engagement of the hooks 26 of the male part 12 into the loops 32 of the female part 14.

We have developed a locking means associated with the hooks and loops to prevent the disengagement of the parts through vibrational or other forces developed within the environment of the metallurgical furnace. While the various locking means are disclosed in connection with a hook-like device, it will be recognized that the locking means could likewise be adapted to the tabs and slots and additionally other connection means presently employed on refractory members in substitution for the previous welded attachments.

Figure 2:
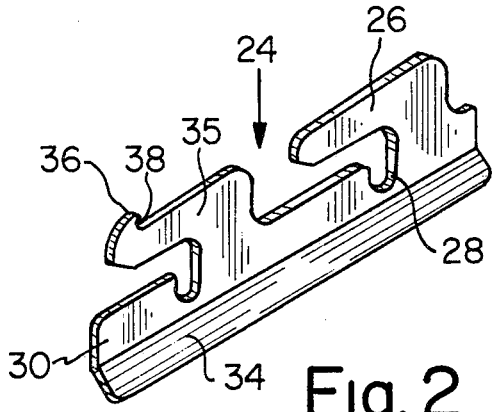
FIG. 2 is a perspective view of one form of locking means of our invention.
Figure 3:
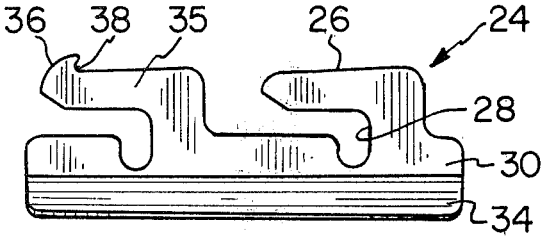
FIG. 3 is a frontal view of the clip of FIG. 2.
Figure 5:
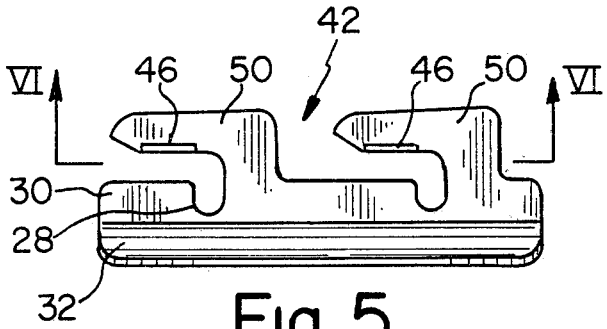
FIG. 5 is a frontal view of a clip having a right angle locking projections.
Figure 4:
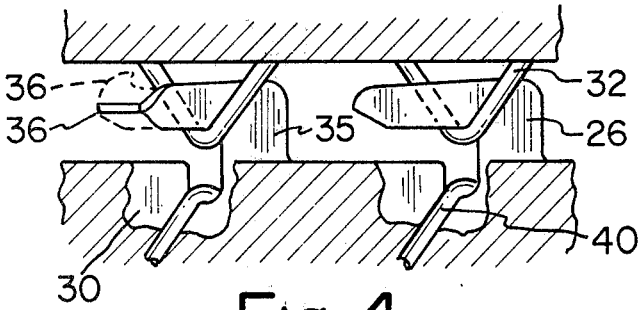
FIG. 4 is a partial section through a portion of a refractory member showing the clip of FIGS. 2 and 3 in assembled relationship.
Figure 6:
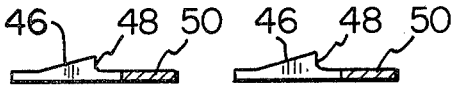
FIG. 6 is a section taken along lines VI—VI of FIG. 5.
Figure 7:
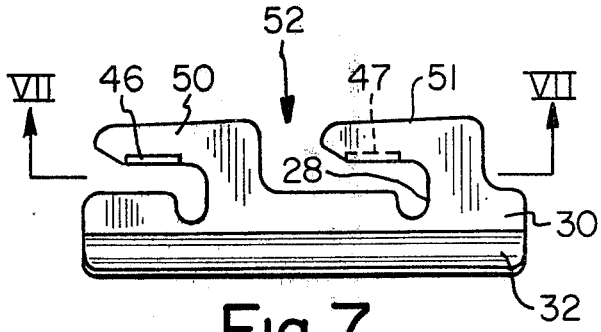
FIG. 7 is a modified form of the clip of FIG. 5.
Figure 8:
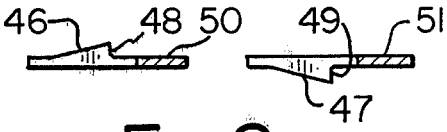
FIG. 8 is a section taken along section lines VIII—VIII of FIG. 7.

In one form of our invention, the clip 24 includes a clip body 30 having a lower bent section 34, two upwardly depending hooks 26 and 35 and a recess 28 positioned within the clip body 30 and subjacent each of the hooks 26 and 35, FIGS. 2–4. The recesses 28 are engaged by the reinforcement such as reticulated metal mesh 40, FIG. 4. The bent section 34 of the clip 30 does not form a part of this invention and is used in connection with a bonding technique. The clip does not have to be bent and is flat in many applications. As in the prior art, only the hooks 26 and 35 extend out from the longitudinal edges of the male part.

The rearward hook 26 remains similar to the prior art hooks illustrated in FIG. 1. However, the forward hook 35 includes an upward and outward projection 36 similar in appearance to a fish-hook barb which is in the same plane as the hook. The rearward portion of the projection 36 in the area of the outermost surface of hook 35 defines a recess 38.

In order to install refractory parts embodying the clip 24, it is necessary to initially insert the hooks 35 and 26 of a male part into the loops 32 of the female part, FIG. 4. An installation tool such as a simple metal rod having a slot in one end is then inserted onto the projection 36 and rotated or twisted 90° from the plane of the hook 35. The original position of projection 36 is shown by dotted lines and the installed position is shown by the solid lines in FIG. 4. This places the recess 38 in a position to engage the loop 32, thereby locking the two refractory parts together and preventing the male part from backsliding out of engagement with loops 32. In order to disassemble the parts, it is only necessary to again insert such a tool and rotate the projection 36 back into the plane of the hook 35.

Another embodiment of our locking device is illustrated in FIGS. 5–8. The clip 42 of FIGS. 5 and 6 includes a clip body 30 having the bottom section 32 and the recesses 28 adjacent the hooks 50. Each hook 50 includes a ramped surface 46 terminating in a shoulder 48, FIG. 6. The ramped surface 46 extends 90° outward from the plane of the hook 50. The ramp surface 46 and shoulder 48 also resemble a barb on a fishhook. The ramp surfaces 46 of the two hooks 50 of clip 42 extend outwardly in the same direction. In the embodiment illustrated in FIGS. 7 and 8, the ramp surface 46 having the shoulder 48 extends outward 90° from the plane of the hook 50 and the ramp surface 47 terminating in the shoulder 49 extends outward 90° from the hook 51 in a diametrically opposing direction. In order to assemble the refractory parts containing the clips 42 or 52, it is necessary that there be a reasonably close tolerance on the assembly of the clips and loops since it is necessary to force the loops along the ramp surfaces 46 and/or 46 and 47 so that the wire loops spring back behind the shoulders 48 and form the lock.

Figure 9:
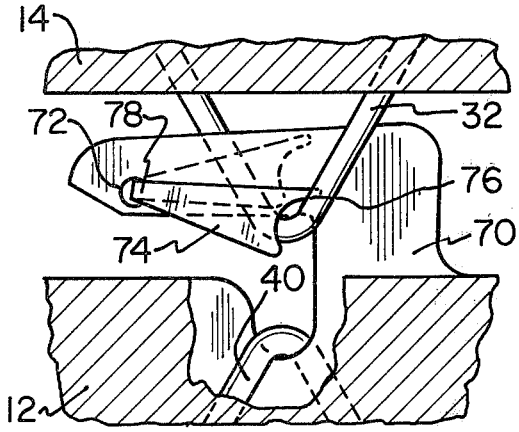
FIG. 9 is a partial section of assembled parts showing a modified locking means.

A further form of locking means is illustrated in FIG. 9. The female part 14 includes a metal loop 32 extending outward from the longitudinal edge thereof. Male part 12 includes a clip (partially shown) embedded in part 12 and further held by reinforcement wire mesh 40. Hook 70 of the clip extends outward from male part 12 and includes a clearthrough clearance hole 72 positioned near the free end thereof. A separate latch member 74 is connected to hook 70 to form the locking means. Latch means 74 includes a bent tab 78 which extends through hole 72 of hook 70. Tab 78 is sized so as to be able to pivot about the center line of clearance hole 72. Tab 78 can be double bent, clipped, pinned or otherwise retained in connective relationship with hook 70. Latch member 74 terminates in a arcuate end surface 76 which forms the lock with loop 32. As the parts 12 and 14 are joined the latch member 74 engages the loop 32 and pivots into the open position illustrated by dotted lines in FIG. 9. When the hook 70 and loop 32 are sufficiently engaged so that loop 32 is rearward of latch member 74, latch member 74 falls into the closed position thereby engaging arcuate end surface 76 with loop 32 and locking the parts 12 and 14 together.

Figure 10:
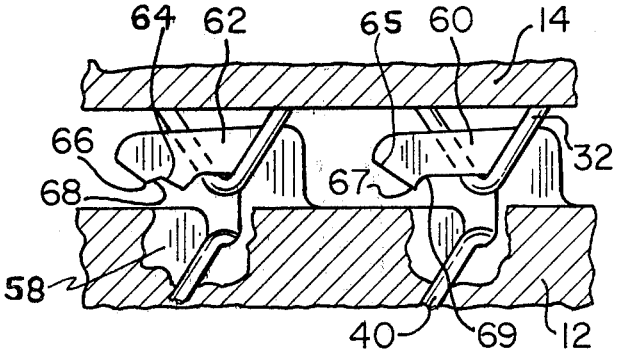
FIG. 10 is a partial section of assembled parts showing a further modified locking means.

The clip 58 of FIG. 10 provides another form of locking parts 12 and 14 together in the assembled condition. The clip 58 includes two hooks 60 and 62. Hooks 60 and 62 include loop engaging, undulating surfaces 65 and 64, respectively. Undulating surface 65 comprises a peak 67 and an adjacent valley 69. Undulating surface 64 of hook 62 includes a pair of peaks 66 and a pair of adjacent valleys 68. The distance between the peaks of the undulating surface 64 and undulating surface 65 are correlated with the distance between the loops 32 so that the male part 12 is actually walked onto the female part 14. In other words, when the loop goes over the lobe of the rear hook, the loop is down in the front hook and when the loop goes over the lobe of the front hook the rear loop is down in the rear hook. This wiggly motion makes the halves easy to assemble by supporting the weight of the lower half and walking the parts together. The parts are prevented from walking apart when assembled since the weight of the parts is sufficient to keep the loops locked behind the lobes of the hooks. There is no unpredictable deformation of material which may define an open path for the members to disengage from one another.

Figure 11:
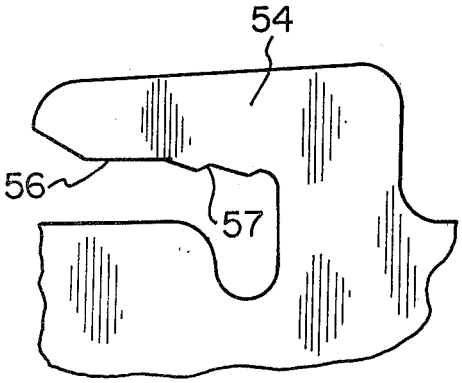
FIG. 11 is a frontal view of a portion of still a further modified form of locking means.

A modified version of the undulating surface hooks is illustrated in FIG. 11. Each hook 54 of the embodiment of FIG. 11 includes a loop engaging ramped stepped surface 56 defining a series of shoulders 57. Upon assembly the loop member is forced along the ramp and over the step surface 56. This causes the stepped surface 56 to lock in place behind a given shoulder 57 when the two refractory parts engage each other along their marginal edges.

It will be recognized that other forms of locking means can be associated with the hooks and loops. For example, the loop engaging surface of the hook may include a single projection in the same plane as the hook so that force is necessary to place the loop behind the projection to form the hook. The foregoing examples and embodiments are illustrative only of the presently preferred forms of the subject invention. Numerous modifications and changes will be readily apparent to those skilled in the art and the subject application is not limited to the exact construction or configuration shown or described and accordingly all suitable modifications and substitution of equivalents may be made therein without departing from the true scope of the invention as defined by the appended claims.

We claim:

1. A protective refractory elongated hollow member for protecting pipe and the like in high temperature metallurgical furnaces comprising an arcuately shaped male part and an arcuately shaped female part interconnected at their respective longitudinal edges to form said member, said male part including a clip partially embedded within the part and including at least a first and second spaced apart hook extending outward from the longitudinal edges, said female part having at least one hook receiving member partially embedded within the part and including loops extending outward from the longitudinal edges for receiving the hooks, at least one of said hooks including locking means for engaging the loop and preventing the disengagement of the parts.

2. The member of claim 1, said locking means comprising a projection extending outward from and in a plane of at least one of said hooks, said projection adapted for twisting movement to a position 90° removed from said plane to contain the loop between the projection and the hook.

3. The member of claim 2, said projection including an arcuate recess for retainable engagement with the loop in the twisted position.

4. The member of claim 1, said locking means comprising a projection extending outward from and at right angles to a plane of at least one of said hooks, said projection increasing in width from an entry end to a termination point which defines a stop shoulder for engaging the loop which rides over the projection during installation.

5. The member of claim 4, including two projections with the projection from said first hook extending outward in a direction diametrically opposite the projection from said second hook.

6. The member of claim 1, said locking means comprising a stepped loop engaging surface extending from and in the plane of the hooks, said stepped surface defining a series of stop shoulders increasing in depth to increasingly frictionally engage the loops.

7. The member of claim 6 wherein each hook includes a loop engaging surface defined by peaks and valleys, the respective peaks and valleys of the first and second hooks being staggered with respect to the distance between loops at a common point so that the male part can be walked over the female part to obtain the locking.

8. The member of claim 1, said locking means comprising a latch pivotably connected to at least one of said hooks, said latch operable between a first position wherein it pivots to an open position through engagement with the loop and a second position wherein it drops into a closed position retaining the loop within the hook.

9. The member of claim 8, said hook having a pivot hole therethrough, said latch connected to said hook through said pivot hole and including a distal curved surface to engage and retain the loop in the closed position.

* * * * *